US008826775B2

(12) United States Patent
Vienneau et al.

(10) Patent No.: US 8,826,775 B2
(45) Date of Patent: Sep. 9, 2014

(54) STAPLE HOLDER

(76) Inventors: Matthew Vienneau, Milford, CT (US); Kevyn L. Kilgore, Milford, CT (US)

( * ) Notice: Subject to any disclaimer, the term of this patent is extended or adjusted under 35 U.S.C. 154(b) by 250 days.

(21) Appl. No.: 13/463,878

(22) Filed: May 4, 2012

(65) Prior Publication Data

US 2013/0019718 A1 Jan. 24, 2013

Related U.S. Application Data

(60) Provisional application No. 61/509,709, filed on Jul. 20, 2011.

(51) Int. Cl.

| | |
|---|---|
| ***B25F 1/02*** | (2006.01) |
| ***B25C 3/00*** | (2006.01) |
| ***B25C 11/00*** | (2006.01) |
| ***B25F 1/00*** | (2006.01) |

(52) U.S. Cl.

CPC ..... *B25C 11/00* (2013.01); *B25C 3/006* (2013.01); *B25F 1/00* (2013.01)

USPC ..... 81/44; 7/167

(58) Field of Classification Search

CPC ..... B25F 1/02; B25C 3/00

USPC ..... 7/167; 81/44

See application file for complete search history.

(56) References Cited

U.S. PATENT DOCUMENTS

| | | | | |
|---|---|---|---|---|
| 1,087,092 | A | 2/1914 | Stingle | |
| 1,100,208 | A | 6/1914 | Watts | |
| 2,356,693 | A * | 8/1944 | Fridolin | 254/28 |
| 2,400,988 | A * | 5/1946 | Goessel | 254/28 |
| 4,256,157 | A | 3/1981 | Grayson | |
| 4,553,737 | A * | 11/1985 | Yi | 254/28 |
| 4,903,882 | A | 2/1990 | Long | |
| 6,513,788 | B1 * | 2/2003 | Ashe | 254/28 |
| 7,131,636 | B1 * | 11/2006 | Gurmu | 254/28 |
| 2005/0092974 | A1 * | 5/2005 | Ness | 254/28 |
| 2006/0101948 | A1 | 5/2006 | Meitzler | |
| 2008/0184494 | A1 | 8/2008 | Govotski | |
| 2010/0187487 | A1 * | 7/2010 | Khan | 254/28 |

* cited by examiner

*Primary Examiner* — Hadi Shakeri
*Assistant Examiner* — Danny Hong
(74) *Attorney, Agent, or Firm* — Michael A. Blake

(57) ABSTRACT

A staple holder comprising: a handle; a head attached to a first end of the handle; a staple remover attached to a second end of the handle; an insulated layer in communication with the head; a slot located in the head and in the insulated layer; and a magnet located in the head, and adjacent to the slot.

7 Claims, 4 Drawing Sheets

STAPLE HOLDER

CROSS-REFERENCES

This patent application claims the benefit of provisional patent application Ser. No. 61/509,709 by Matthew Vienneau and Kevyn Kilgore, entitled "Staple Holder", filed on Jul. 20, 2011, the entire contents of which are fully incorporated by reference herein.

TECHNICAL FIELD

This invention relates to staple holders, and more specifically to a staple holder that is configured to hold staples used to attach wires and cables throughout a building or other structure.

BACKGROUND

When fastening electrical wire with a staple, it is often necessary for the technician to hold the staple in his hand while the staple is hammered into place. It is often difficult to get a good grip on the staple while also trying to protect the fingers from the hammer. Often, an individual will accidentally strike their fingers with the hammer. This is especially true when working in tight spaces, when trying to work while wearing gloves, and/or when working in awkward positions.

Therefore, there is a need for an apparatus to hold staples, such as U-shaped staples, during installation of wires, cables, and lines that overcomes or minimizes the above-referenced and other disadvantages.

SUMMARY

The disclosed invention relates to a staple holder comprising: a handle; a head attached to a first end of the handle; a staple remover attached to a second end of the handle; an insulated layer in communication with the head; a slot located in the head and in the insulated layer; and a magnet located in the head, and adjacent to the slot.

BRIEF DESCRIPTION OF THE DRAWINGS

The present disclosure will be better understood by those skilled in the pertinent art by referencing the accompanying drawings, where like elements are numbered alike in the several figures, in which.

DETAILED DESCRIPTION

Figure 1:
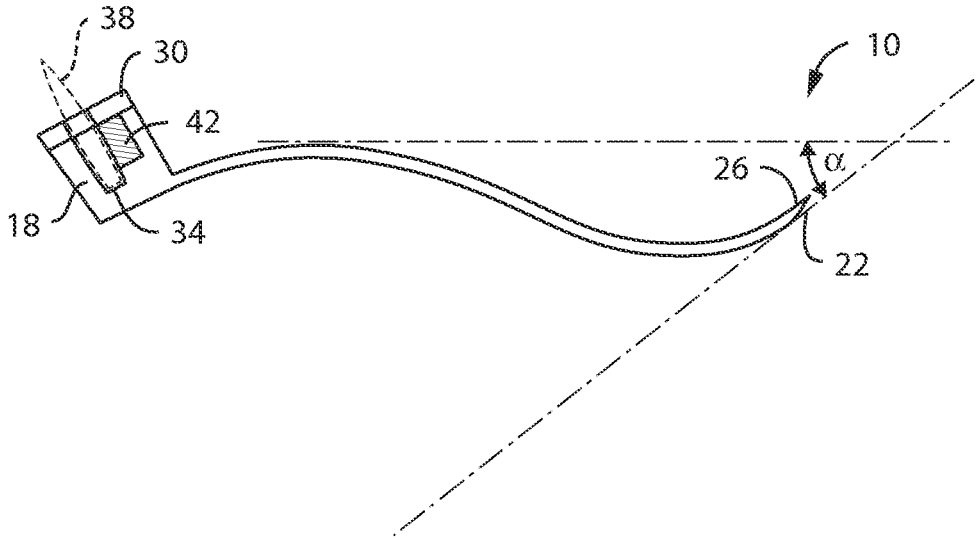
FIG. 1 is a side cross-sectional view of the staple holder.
Figure 2:
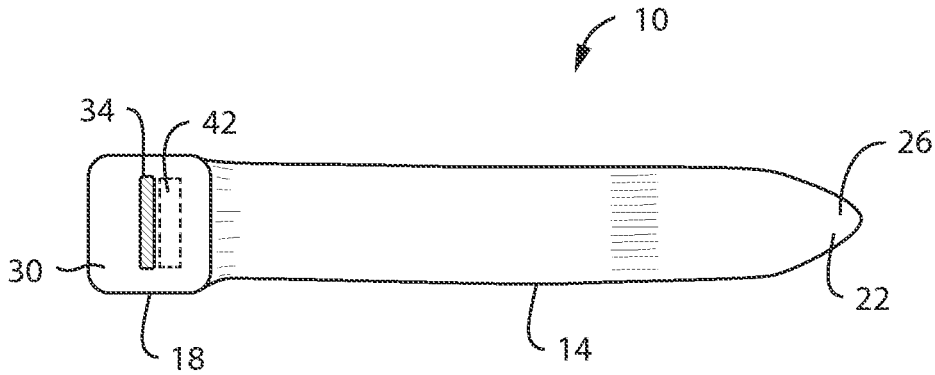
FIG. 2 is a top view of the staple holder from FIG. 1.

FIG. 1 is a side cross-sectional view of a staple holder 10. The staple holder 10 comprises a handle 14 and a head 18 in communication with the handle 14. The handle 14 may have the generally curved shape shown. In one embodiment, the bottom end 22 of the handle 14 may be configured be a staple remover 26. The staple remover 26 forms generally an angle $\alpha$ with the handle 14. Angle $\alpha$ may be any suitable angle for providing suitable leverage to remove a staple using the staple remover 26. The angle $\alpha$ may range from about 20° to about 80°. The head 18 comprises a cushioned and/or insulated layer 30. The layer 30 may be made out of any suitable material that will provide cushioning such that when the staple holder is used, damage to the wire, cable, or line will be generally prevented. Some materials that the layer may be made out of include, but are not limited to plastic, rubber, nylon, etc. The head has a slot 34 configured to generally hold a staple 38 (shown in dashed line) for fastening electrical wire, cable, and other lines. Adjacent to the slot 34 is a magnet 42. The magnet 48 is configured to hold a staple 38 in the slot 34, so that the staple 38 will generally remain in the slot 34 even if the staple holder 10 is turned over, such that the staple 38 would slide out of the slot 34 if not for the magnet 48 holding the staple 38 within the slot 34. In other embodiments, the magnet 48 may be powerful enough to also be able to pull one or more staples out of a bag or other supply of staples, so that a user will not have to use his or her fingers to grab a staple out of a bag and perhaps prick his or her finger with the staples. In one embodiment, as shown in FIG. 2, the slot 34 is generally perpendicular to the handle 14. However, in other embodiments, the slot may be angled with respect to the handle 14, or may be generally parallel with respect to the handle 14. In addition, the angle holder 10 may be suitably sized to fit staples of various sizes. In one embodiment, the slot may be about ¾ of an inch long by about 3/16 of an inch wide, and about ⅝ of an inch deep. However, larger or smaller slots in larger or smaller heads configured to fit larger or smaller staples are contemplated within this disclosure. In one embodiment, the length of the staple holder may range from about 2 inches to about 24 inches, and preferably is about 4 and a half inches. The staples that be used with the staple holder can fasten many different types of wire and cable, including but not limited to: romex cables sizes 14/2, 14/3, 14/4, 12/2 12/3, 12/4, and combinations of the 14's and 12's; Armor type cables, BX and Mc, 14/2, 14/3, 12/2, 12/3, 10/2; Bell wire 18-2 to 18-12; Alarm cabling; TV cabling; audio and video cables; Phone cable; and computer cables, cat-5 and cat-6.

FIG. 2 shows a top view of the staple holder 10. In this view the magnet 42 is shown in dashed line because it is under the surface of the layer 30. However, the magnet 42 is clearly shown adjacent to the slot 34. The staple 38 is not shown in this view. The staple remover 26 is shown with a generally narrowed end to accommodate the removal of a staple.

Figure 3:
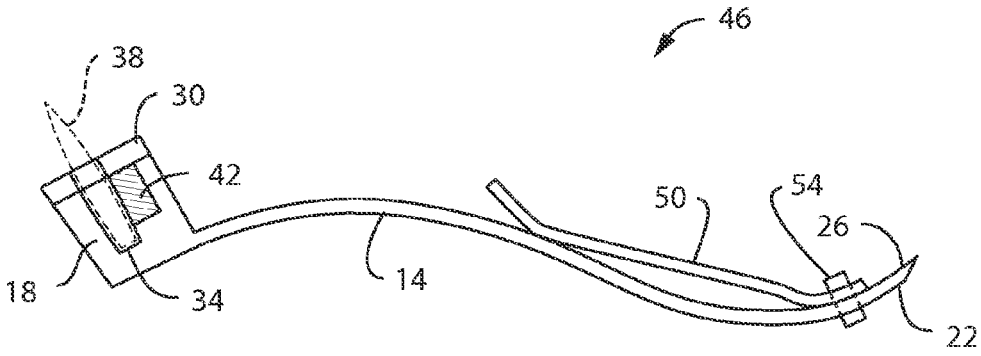
FIG. 3 is a side cross-sectional view of a staple holder embodiment with a belt clip.

FIG. 3 shows a side view of another embodiment of a staple holder 46. In this embodiment, a belt clip 50 is attached to the handle 14. In this embodiment, the belt clip 50 may be attached to the handle 14 via one or more rivets 54.

Figure 4:
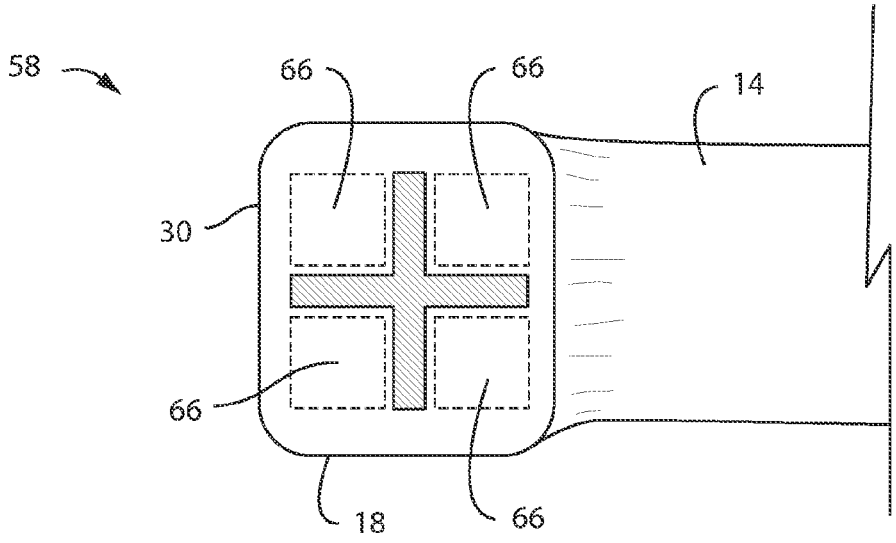
FIG. 4 is a top view of another embodiment of the slots.

FIG. 4 shows a top close up view of a head 18 of another embodiment of a staple holder 58. In this embodiment, the slot 62 is cross or "T" shaped. Thus a staple can be placed in the portion of the slot 62 that is generally orthogonal to the handle 14, or the staple can be placed in the portion of the slot 62 that is generally parallel to the handle 14, depending on the need of the user. Several magnets 66 may be placed as shown under the layer 30 adjacent to the slot 62. The magnets 66 are configured to hold a staple in either the parallel or orthogonal portion of the slot 62.

Figure 5:
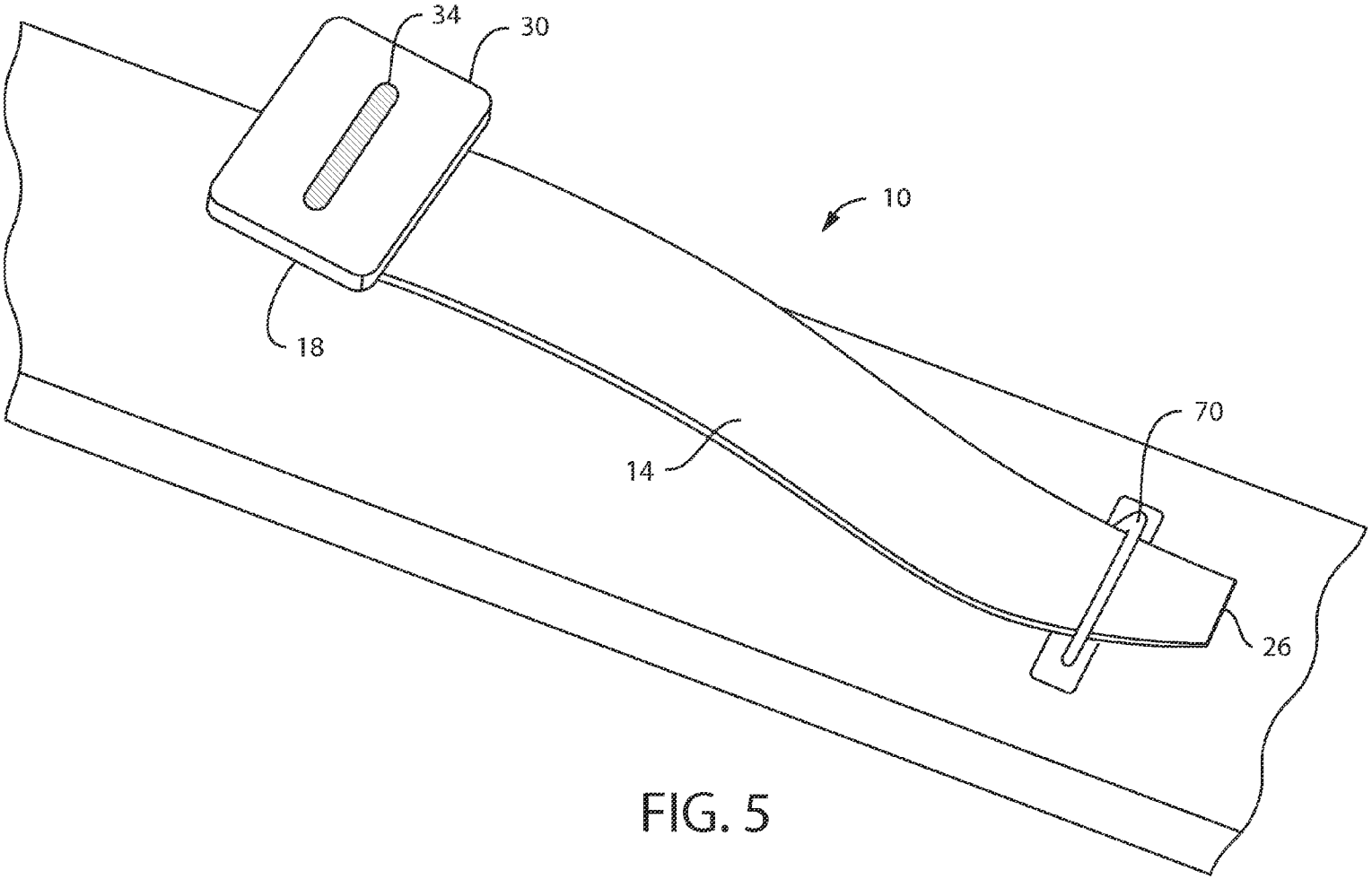
FIG. 5 is a perspective view of the staple holder being used to remove a staple.

FIG. 5 shows an embodiment of the staple holder 10 being used to remove a staple 70. Due to the angle of the staple remover 26 with respect to generally the remainder of the handle 14, the staple holder 10 handle 14 can be used as a lever with respect to the staple remover 26 to pry up the staple 70.

Figure 6:
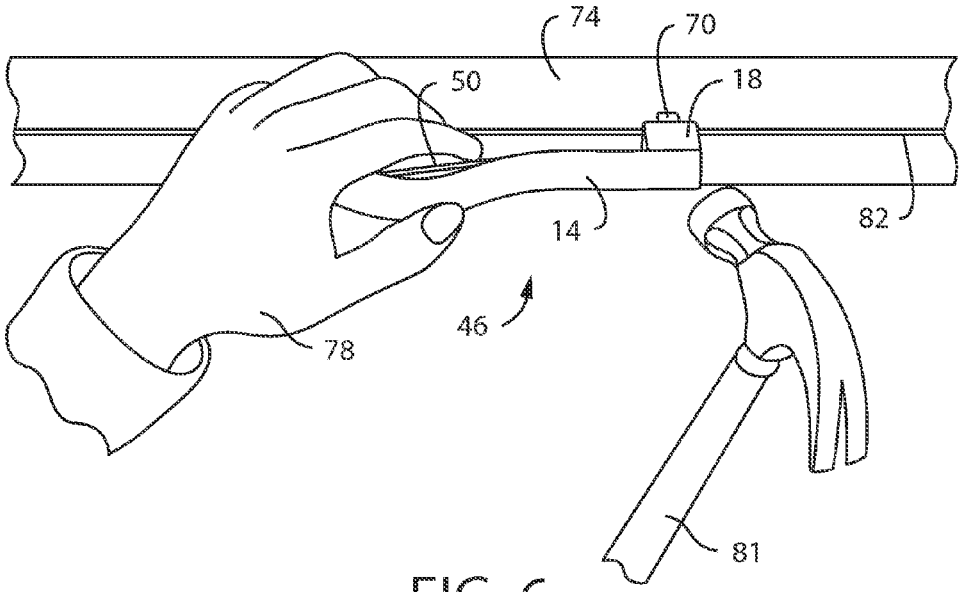
FIG. 6 is a perspective view of the staple holder holding a staple during use.
Figure 7:
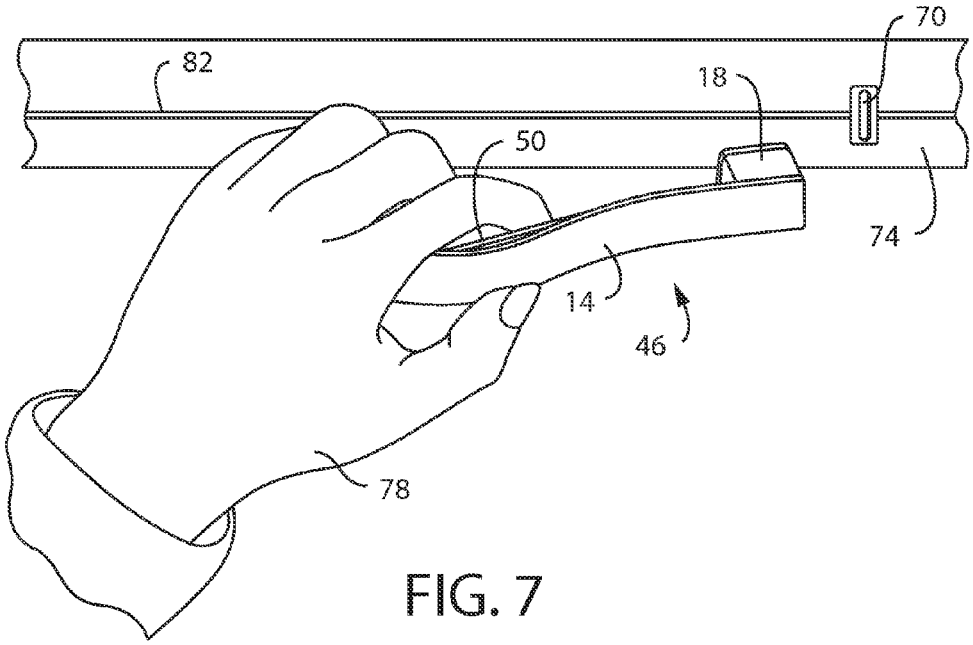
FIG. 7 is a perspective view of the staple holder after installing a staple.

FIG. 6 shows how one embodiment of the staple holder 46 can be used to install a staple 70 to hold a cable 82 against the ceiling 74. The staple 70 is located in the slot 34 of the head 18 with the points of the staple 70 directed away from the head 18 and towards the ceiling 74. The staple holder 46 allows one to easily move and position the staple 70 so that it can be attached to a wall, ceiling, floor, or any other structure, and the staple 70 will stay in the slot 34 due to the magnet 42. In this view, the user 78 is holding the staple holder 46 up against a ceiling, and is ready to hit the head 18 with a hammer 81 to fasten the staple 70 to the ceiling 74. FIG. 7 shows the user 78 moving the staple holder 46 away from the ceiling 74, and the staple 70 now attached to the ceiling with a cable 82 held against the ceiling 74 by the staple 70.

The disclosed device has many advantages. The staple holder makes it easier to install staples while protecting the fingers of a user because the magnet holds the staple within the slot instead of having to hold the staple with one's fingers and possibly hitting the fingers with a hammer. The staple holder makes it easier to install staples on ceilings and in awkward places, such as between two tightly spaced studs (2×4, 2×6, etc.); around main beams; and in work areas with pipes, ducting and other obstructions in the way. The staple holder protects the cable, wire, or line being installed due to the cushioned layer. The staple holder can be a useful tool for Electricians, Alarm installers, Phone line installers, cable TV installers, audio—video installers, heating and cooling low-voltage cable installers and projects that involves cable or wire installations by professionals or do it yourself types.

It should be noted that the terms "first", "second", and "third", and the like may be used herein to modify elements performing similar and/or analogous functions. These modifiers do not imply a spatial, sequential, or hierarchical order to the modified elements unless specifically stated.

While the disclosure has been described with reference to several embodiments, it will be understood by those skilled in the art that various changes may be made and equivalents may be substituted for elements thereof without departing from the scope of the disclosure. In addition, many modifications may be made to adapt a particular situation or material to the teachings of the disclosure without departing from the essential scope thereof. Therefore, it is intended that the disclosure not be limited to the particular embodiments disclosed as the best mode contemplated for carrying out this disclosure, but that the disclosure will include all embodiments falling within the scope of the appended claims.

What is claimed is:

1. A staple holder comprising:

a handle, the handle comprising a first end and a second end;

a head attached to a first end of the handle, the head comprising a handle attachment side and a slot side opposite the handle attachment side, and the head attached to the handle at its head attachment side;

a staple remover attached to a second end of the handle;

an insulated layer in communication with the head;

a slot located in the head on the slot side of the head and in the insulated layer, the slot being exposed and uncovered; and a magnet located in the head, and immediately adjacent to the slot, the magnet configured to hold a staple in the slot; wherein the head is hammerable.

2. The staple holder of claim 1, wherein the handle forms an angle $\alpha$ with the staple remover, and where angle $\alpha$ is between about 20° and about 80°.

3. The staple holder of claim 1, wherein the layer is made out of the material selected from the group consisting of plastic, rubber, and nylon.

4. The staple holder of claim 1, further comprising:

a belt clip attached to the handle.

5. The staple holder of claim 1, wherein the slot is generally perpendicular to the handle.

6. The staple of holder of claim 1, wherein the slot is generally parallel to the handle.

7. The staple holder of claim 1, wherein the slot is cross-shaped, with one portion of the slot generally parallel to the handle, and another portion of the slot is generally perpendicular to the slot.

* * * * *